US005365699A

United States Patent [19]

Armstrong et al.

[11] Patent Number: 5,365,699

[45] Date of Patent: Nov. 22, 1994

[54] BLAST CLEANING SYSTEM

[76] Inventors: Jay Armstrong, 1543 Weymouth Cir., Apt. 109, Westlake, Ohio 44145; James R. Becker, 6272 Mills Creek La., North Ridgeville, Ohio 44039

[21] Appl. No.: 925,525

[22] Filed: Aug. 5, 1992

Related U.S. Application Data

[63] Continuation-in-part of Ser. No. 589,042, Sep. 27, 1990, Pat. No. 5,184,427.

[51] Int. Cl.[5] ..... B24B 49/00

[52] U.S. Cl. ..... 451/7; 451/40; 451/75; 451/99

[58] Field of Search ..... 51/165.73, 321, 410, 51/322, 320, 436

[56] References Cited

U.S. PATENT DOCUMENTS 4,389,820 6/1983 Fong et al. ..... 51/320
4,727,687 3/1988 Moore ..... 51/322
4,744,181 5/1988 Moore et al. ..... 51/322
4,947,592 8/1990 Lloyd et al. ..... 51/322

*Primary Examiner*—M. Rachuba

[57] ABSTRACT

This invention relates to a carbon dioxide blast cleaning system for propelling dry-ice pellets by cryogens, namely high pressure nitrogen, helium and/or oxygen, against a surface being cleaned. Carbon dioxide pellets, in a pellet hopper, a blast unit and a blast gun are located at a blast site near the surface being cleaned. A portable cryogenic liquid nitrogen, liquid helium and/or liquid air tank with an ambient air vaporizer is also located at or near the blast site. Cryogenic liquid nitrogen, liquid helium and/or oxygen flow through the ambient air vaporizer to the liquid and is vaporized to form a high pressure gas. The high pressure, cryogenic gas is then brought into the blast unit and mixed with the pellets. The mixture of the high pressure gas and the pellets exit the gun nozzle at high velocities to blast the surface being cleaned.

2 Claims, 4 Drawing Sheets

BLAST CLEANING SYSTEM

This is a continuation-in-part of U.S. application Ser. No. 07/589,042 filed Sep. 27, 1990 now U.S. Pat. No. 5,184,427.

FIELD OF THE INVENTION

This invention relates to blast cleaning methods and particularly to blast cleaning systems which use pellets of solid carbon dioxide.

BACKGROUND OF THE INVENTION

Solid carbon dioxide blast cleaning is used in place of abrasive blasting systems and other blast cleaning systems to remove paint or other coatings/contaminants from surface areas. Most blast cleaning systems generate additional waste material which must be removed after the blast cleaning operation has been completed. In sandblasting, for example, sand is used as the blasting materials and a residual of sand is left around the area that has been blast cleaned. Using a material, such as solid carbon dioxide, in blast cleaning operation is advantageous because no residual blasting material remains, since the solid carbon dioxide sublimates to become gaseous carbon dioxide upon impacting the surface or warming. For this reason solid carbon dioxide blast cleaning is the preferred method of cleaning surfaces in certain environments where removal of the residual is difficult or impossible.

An example of carbon dioxide blast cleaning system is shown in U.S. Pat. No. 4,617,064, issued Oct. 14, 1986, to Moore.

Currently available commercial systems commonly have several standard components some of which are generally located on a large truck which is moved adjacent to the blast cleaning area and along with other components that are located at the blast site. Components located at the blast site are connected to the components carried by the truck through various flexible hoses and electric cables. In such systems, the truck typically carries a portable carbon dioxide vessel and other necessary equipment and machinery. The small portable carbon dioxide vessel includes an air compressor, diesel or electric generator for power supply, pelletizer with air dryer and feed system, and accompanying high pressure hose equipment. A large external carbon dioxide storage vessel (supply) is employed in such systems and is normally six (6) tons or greater in capacity. Since the rate of carbon dioxide usually varies between 500 pounds per hour to 1500 pounds per hour, the large external carbon dioxide storage vessel, which is supplying the smaller portable carbon dioxide vessel, may require filling more than once per day.

The air compressor employed is commonly a screw-type, having a rating of air flow at a range up to 500 cubic feed per minute at maximum pressures of around 250 PSI . An external power supply is required and a power supply of at least 70 amps and 220/460 volts is commonly utilized. Such external power is normally supplied by a portable generator located on the truck.

Located remotely therefrom at the blast site in such systems are a portable vessel containing liquid carbon dioxide, pelletizer, an air dryer, and a blasting gun having a nozzle to direct the pellets. A portable carbon dioxide vessel, normally holding approximately two tons, is filled from a large carbon dioxide storage vessel on the truck. The portable carbon dioxide vessel is adapted to be wheeled or otherwise moved to the blast site when pelletizing equipment is utilized to turn the liquid carbon dioxide into small carbon dioxide pellets. The pelletizing equipment normally has a typical capacity rate of around 200–500 pounds per hour of dry ice production. The pelletizer is operated by an electric power source through cable and flexible compressed air lines, as referred to hereinbefore, from a source of power supply and an air compressor mounted on the truck. Once pellets are made as stated, the same are delivered to a blasting gun attached to the pelletizer and driven by compressed air toward the surface to be cleaned.

The design of the pelletizer is well known in the art. A good description of the pelletizer is contained in the U.S. Pat. No. 4,617,064 issued Oct. 14, 1986 to Moore. Disclosure of this patent is hereby incorporated by reference. As stated above, a large liquid carbon dioxide storage tank is carried on the truck but said tank could also contain liquid air or other liquifiable gas which when vaporized can produce high pressure propellants.

Compressed air is carried from the compressor mounted on the truck by the flexible hose or cable to the blasting gun area after first passing through an air dryer normally located at the blasting site. The air dryer operates to lower the dew point of the compressed air down to −40 degrees Fahrenheit, to prevent water vapor from causing problems during the blasting process.

The above described currently available system has several inherent disadvantages. First, a multiplicity of lines, both air and electrical, must be run from the truck located outwardly of the blast area.

Secondly, available pressure from a conventional air compressor is limited to 250 pounds per square inch. The use of such commercial air compressors is not only difficult in operation but expensive.

Thirdly, the system ties the pelletizing machinery directly to the blast mechanism at the blasting site creating problems due to space limitations at the blasting site and requires that the components act as one unit rather than independently of one another.

Further, in the commercially available systems discussed hereinbefore, reduction of the moisture level of the incoming air down to a dew point of about −40 degrees Fahrenheit is necessary.

Another example of the prior art carbon dioxide blast cleaning system is U.S. Pat. No. 4,389,820 to Fong et al. The latter patent provides for the introduction of particles of carbon dioxide into a lower pressure transport gas flow. The gas flow with the paticles is then delivered to a nozzle to be accelerated and directed against the surface being cleaned. Fong's disclosure specifically states that the propellant gas temperatures are in the range of 100 degrees to 275 degrees Fahrenheit (F). The elevated temperature is essential to prevent freezing of the system (see Column 5, Line 65 to Column 6, Line 5). When the dry ice particles, having a temperature of approximately −109 degrees F., come into contact with the elevated gas flow temperature above 100 degrees Fahrenheit, the pellets will immediately begin to sublimate. The resulting reduction in the mass of dry ice particles decreases the efficiency of the blasting system.

The object of the present invention is to produce a carbon dioxide blast cleaning system and method of using the system in which carbon dioxide pellets are instantly available and are located at the blast site for instant use.

A further object of the invention is to produce a carbon dioxide blast cleaning system and method of using the system which is inexpensive in manufacture, being composed of fewer parts, and highly efficient in operation.

Another object of the invention is to provide a carbon dioxide blast cleaning system and method of using the system which eliminates the multiplicity of components located at a considerable distance from the blast site in the blasting operation as in the prior art systems.

A still further object of the present invention is to provide a carbon dioxide blast cleaning system and method of operating the system wherein the temperature of the propelling gas is low enough to prevent premature sublimation of the carbon dioxide pellets.

Still another object of the present invention is to provide a carbon dioxide blast cleaning system and method operating the system wherein the entire system is portable and easily moved and set up at a blasting site.

Other objects of the invention and the invention itself, will become apparent from purview of the appended description in which reference is made to the accompanying drawings.

SUMMARY OF THE INVENTION

This invention relates to a carbon dioxide blast cleaning system. In the present invention, the propelling of the dry ice pellets is provided by cryogens, namely nitrogen, helium and/or oxygen supplied under high pressure.

In a preferred embodiment, carbon dioxide pellets are placed into a portable pellet hopper and a portable, liquid cryogenic nitrogen, helium and/or liquid oxygen storage tank is employed along with a portable blasting unit. The portable pellet hopper, the portable cryogenic liquid nitrogen, helium and/or oxygen storage tank with an ambient air vaporizer to convert the liquid to a gas, a blast unit and gun(s) are located near the blast site.

In another embodiment of this invention, as distinguished from the prior art, all the equipment and material for cleaning, with the exception of the cryogenic liquid nitrogen ($N_2$), oxygen ($O_2$) and/or helium (He) are located at the blast site. Thus, the system requires only one cable or hose running to the blast site for delivering high pressure cryogenic gas. There are, however, no cables or hoses to an air compressor or generator located away from the blast site. Pellets from a portable hopper are fed into a blast unit and from there into a blast gun. The cryogenic liquid nitrogen, helium and/or oxygen is caused to pass through an ambient air vaporizer to vaporize the liquid element into gases and to build such gases up to high pressures. The cryogenic gas under high pressure is then brought into the blast gun which is being fed the pellets as aforesaid to effect propulsion of the pellets to high velocities through gun nozzles to blast the surface or surfaces to be cleaned.

In another embodiment of the invention, the cryogenic gas, nitrogen, helium, oxygen and mixtures thereof are stored at high pressure in containers at the blasting site along with the portable pellet hopper, the blasting unit and the blasting gun. A trim heater is provided to control the temperature of the gas mixture and increase the efficiency of the blasting operation.

According to the invention, the temperature of the high pressure cryogenic gas is between about −320 degrees F. and about 150 degrees F. This low temperature operation prevents the premature sublimation of the carbon dioxide being mixed with the gas for propulsion towards the surface being cleaned.

Also according to the invention, the molecules of cryogenic gas are substantially smaller than the size of the molecules found in air. Therefore, the propelling gas is not only effective for blasting the pellets of carbon dioxide against the surface being cleaned, but can penetrate more deeply into the pores of the contaminant being removed. Then the low temperature of the molecules rapidly rises and causes the contaminant to break away from the surface area being cleaned.

DESCRIPTION OF THE PREFERRED EMBODIMENT

Reference is now made to the figures of drawings, in all of which, like parts are designed by like reference numbers. FIG. I discloses a block diagram of the blast cleaning system of the prior art which typically uses a large truck (not shown) located remote from the blast site containing a large carbon dioxide storage tank A, typically six (6) tons or greater, a portable generator B, and an air compressor and air cooler C. At the blast site is a portable liquid carbon dioxide tank F, a pelletizer G, an air dryer H and a blast unit and gun I. Running from the remote locate to the blast site are electrical lines D and hoses E.

Figure 1:
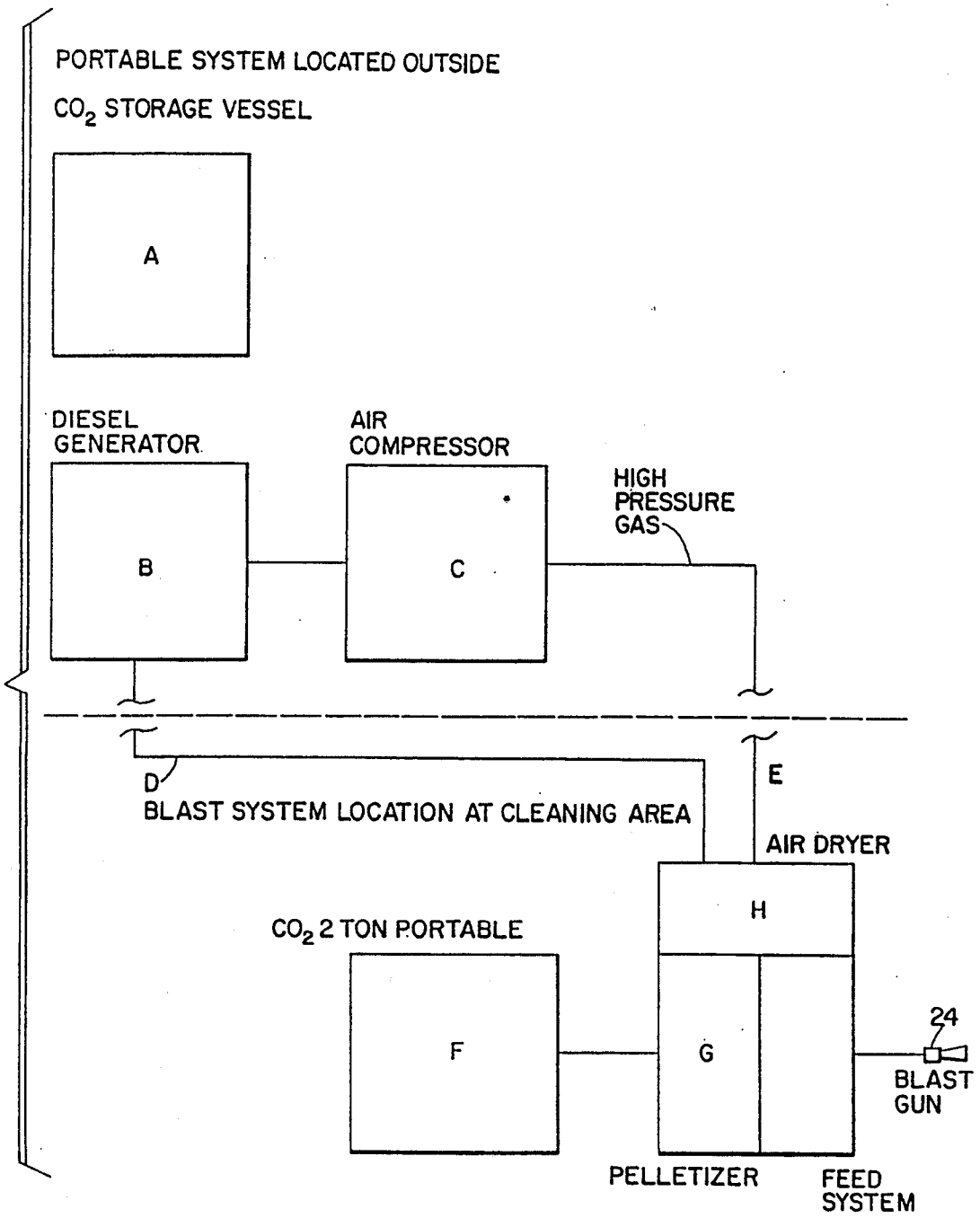
Fig. 1 (PRIOR ART)
FIG. 1—A block drawing of the prior art.
Figure 2:
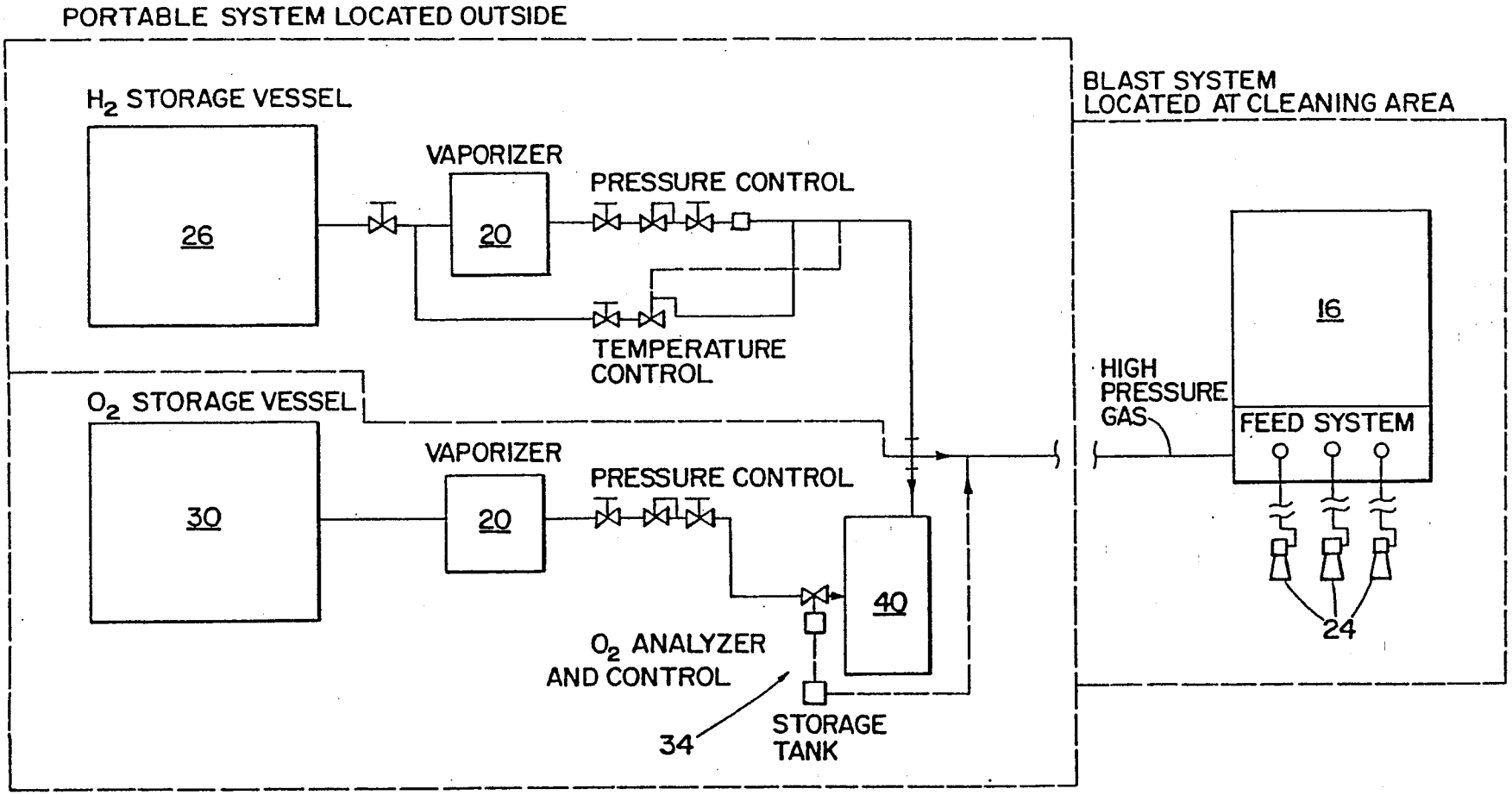
FIG. 2—A block drawing of the components at or near the blast site of one embodiment of the invention.

FIG. 2 is a block diagram of the present invention. In the present invention on the truck ( not shown ) remote from the blast site is a large liquid nitrogen tank. At the blast site is a portable storage hopper 16, with pellets of carbon dioxide and a blast unit and gun(s) 24. One can readily see by looking at FIG. I and FIG. 2, the present invention has only one line, namely a nitrogen line, and does not have any electric line or air hose running from the remote location to the blast site.

Figure 3:
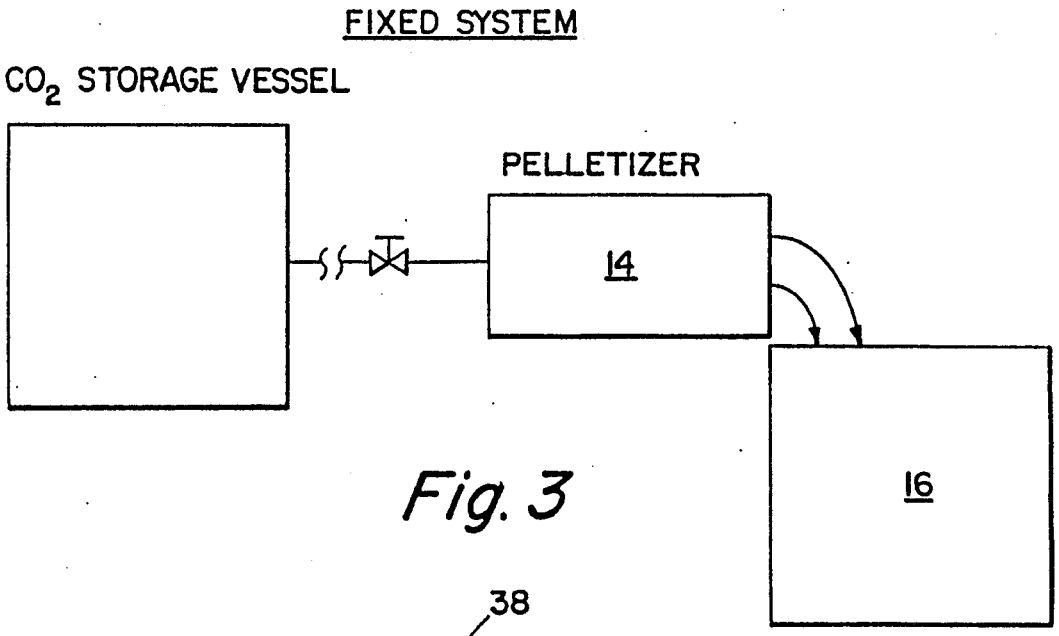
FIG. 3—A block drawing of the components at a fixed site of one embodiment of the invention.

In contrast to the prior art, the present invention pelletizes the dry ice at the remote location, as illustrated in FIG. 3, where the pellets are placed into a pellet hopper 16, which is preferably portable and where the carbon dioxide pellets are stored until use. The said storage hopper 16 (as to use), permits the separation and independent use of the blasting mechanism and the pelletizing equipment. The portable hopper 16, also makes the pellets instantly available at the blast site. A portable storage hopper of the types described has been found to allow pellets stored in it to remain useful for up to three (3) days at a time. The storage hopper in a preferred embodiment is constructed of plastic and/or metal or other similar material and is suitably insulated.

In the present invention the liquid nitrogen from the storage tank 26 is discharged through a portable ambient air vaporizer 20 which vaporizes the liquid nitrogen into high pressure gaseous material and allows for control of the temperature of the material. The portable pellet hopper 16 permits the separation of the blasting equipment from the truck carrying the liquid nitrogen since only one high pressure supply line is required to connect the vaporizer to the blast unit. There are, however, no electric cables or air hoses running from the blast unit back to the truck.

As stated hereinbefore, the portable nitrogen storage vessel 26 is connected to an ambient vaporizer 20 allowing for the vaporization of the liquid cryogen and control of the temperature of the individual cryogen gases . The vaporizer 20 is adapted to supply high pressure gases such as nitrogen fully vaporized up to 3,000 pounds per square inch. The vaporizer 20 also can be used to mix liquid oxygen from an oxygen tank 30, as shown in FIG. 2, with nitrogen. The nitrogen from the vessel 26 can be mixed with the oxygen from the oxygen tank 30 to provide an output which only comprises high pressure air equivalence of 100% nitrogen or any combination inbetween by mixing the nitrogen and oxygen and controlling the vaporization thereof wherefor temperatures of the resulting high pressure gases may be controlled. The temperature of the output thus depends in part upon the mix of nitrogen and oxygen and the resulting temperature may be anywhere between ambient down to −200 degrees F., and in some cases, down to −320 degrees F. The high pressure gas is transferred from an ambient air vaporizer 20 to the blast gun 24 by a hose line which is preferably flexible to allow free movement of the blast gun 24. The pressure supply to the blast gun 24 can be varied from any amount above 0 pounds per square inch (PSI) to 500 PSI or greater and between 0 cubic feet per minute (CFM) to 500 CFM or greater depending on the blasting requirement. These pressures will be able to propel the pellets at subsonic or supersonic velocities through the blast gun(s) 24.

The pellet hopper 16 is also connected to the blast unit which is then connected to a blast gun(s) 24. The pellet hopper 16 supplies pellets of dry ice contained therein by means of gravity feed, vibration, vacuum and/or pressurized fluidization created by the gaseous nitrogen supply under pressure through rigid or flexible hose lines. The pellets of carbon dioxide flow at a flow rate which is determined by the operator, through a rigid or flexible hose to the blast gun(s) 24. In the preferred embodiment, the dry ice pellets are supplied at a controlled rate of up to approximately 12.0 lbs per minute to the blast gun. The propellant is the high pressure nitrogen supplied to the blast gun(s) preferably by means of a separate hose line.

Figure 4:
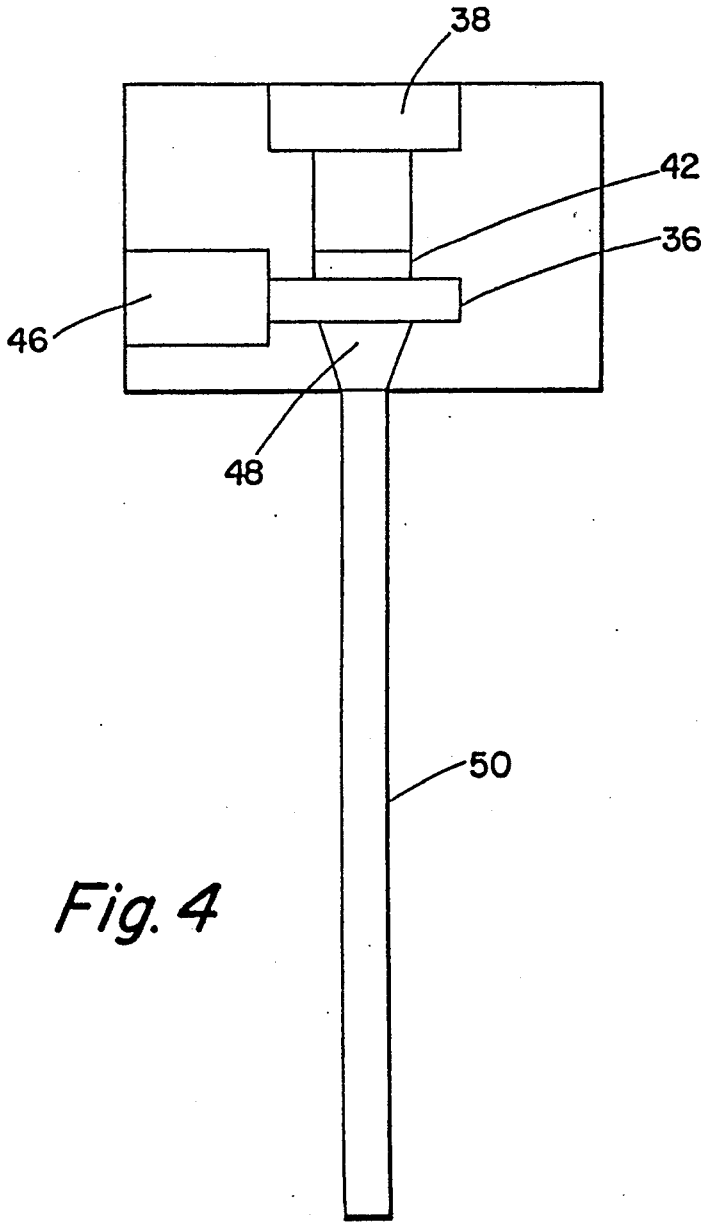
FIG. 4—A block drawing of the blast gun.

The blast gun 24, as shown in detail in FIG. 4, is connected to a high pressure nitrogen line by means of a gas supply line connector 38 and to the pellet hopper and blast unit by means of supply line connectors 46. The gas moves from the supply line connector 38 through a removable and exchangeable venturi 42 which varies inlet pressure and flow with corresponding changes the velocity at the barrel of the gun 50. From this venturi the gas moves into a mixing chamber 36. In the chamber 36 the gas is mixed with pellets supplied from the pellet hopper 16 and sent to the blast gun 24. Preferably the gas propels the pellets through a funnel shaped, or variations thereof, orifice 48 which forcibly ejects the same out through the barrel 50.

In one embodiment of the invention, the propelling gas can be a mixture of both liquid nitrogen and liquid oxygen. This embodiment is well suited for work in confined areas where there may not be enough oxygen for the operator to breathe.

Another embodiment of my invention could use only liquid nitrogen as the propelling gas. In this embodiment only a portable nitrogen tank 26 is attached to the ambient air vaporizer 20. As in the previous embodiment, the liquid nitrogen is turned into high pressure gas in the ambient air vaporizer 20.

In order to provide a closer temperature control of the high pressure gas supply from the ambient air vaporizer 20, a trim heater 40, may be provided. The output from the vaporizer 20 is then supplied to a trim heater 40 which includes an adjustable thermostat and fine tunes the temperature of the gas supply. Thus the trim heater can be used to control the temperatures to the gas at the blast gun 24.

A surge vessel 34 also monitors the oxygen levels in applications in which oxygen is required. In many applications oxygen will not be necessary and the system may be run on 100% nitrogen.

The present invention also includes another embodiment where a system for blast cleaning a surface includes a device for providing a high pressure stream of a cryogenic substance having a temperature between −320 degrees F. and 150 degrees F., a device 16 for storing solid pellets of carbon dioxide, a device for mixing the solid pellets of carbon dioxide into the high pressure stream, and a blast gun 24 means for propelling the mixture of solid pellets and high pressure stream towards the surface to be cleaned.

The cryogenic substance is selected from the group consisting essentially of nitrogen, helium, oxygen and mixtures thereof. Typically, the cryogenic substance is in the very low temperature liquid state. The substance is changed from the liquid state into the gaseous state with an air vaporizer 20, as discussed before. Typically, the selected cryogenic substance is nitrogen or helium. Both substances in the gaseous state are particularly good propellants.

First, the temperature of these gases at the outlet of the blast gun is substantially lower than the air at the gun outlets of the prior art systems. Due to the extremely low temperature, a high thermal differential between the gas and the surface being cleaned creates a large thermal shock potential. The resulting thermal shock provides for effective and rapid contaminant removal.

Secondly, the nitrogen and helium molecules are substantially smaller than the molecules in either air or carbon dioxide. Moreover, the helium molecules are even smaller than the other molecules discussed herein and are particularly useful for a substrate or contaminant coating having extremely low permeability and porosity. These small molecules can penetrate deeper into the pores of a contaminant covering the surface being cleaned. Once the nitrogen or helium molecules are in the pores of the contaminant, their temperature quickly rises and causes them to expand. The effect is a pressure build up behind the contaminants that breaks the contaminants off the area being cleaned. The gas propellant directed against the surface being cleaned then blasts the contaminants from the surface.

A third advantage of the helium and nitrogen is that being inert, they do not form molecular bonds with the contaminant. This effects a more thorough cleaning than propellant gases having a more reactive ingredient, such as oxygen, air and carbon dioxide.

There are situations, however, where it is useful to mix the nitrogen and/or helium with oxygen. For example, there can be a need for oxygen at the blasting site for life support. In such a case the propellant is blended with oxygen from the surge vessel and added to the propellant on demand that is when the oxygen level goes below a preselected value.

In another embodiment of the invention, the cryogenic substance in the liquid state is mixed with the cryogenic substance in the gaseous state. With the temperature of the mixture reduced, it can more easily achieve the advantages of the low temperature propellant.

Figure 5:
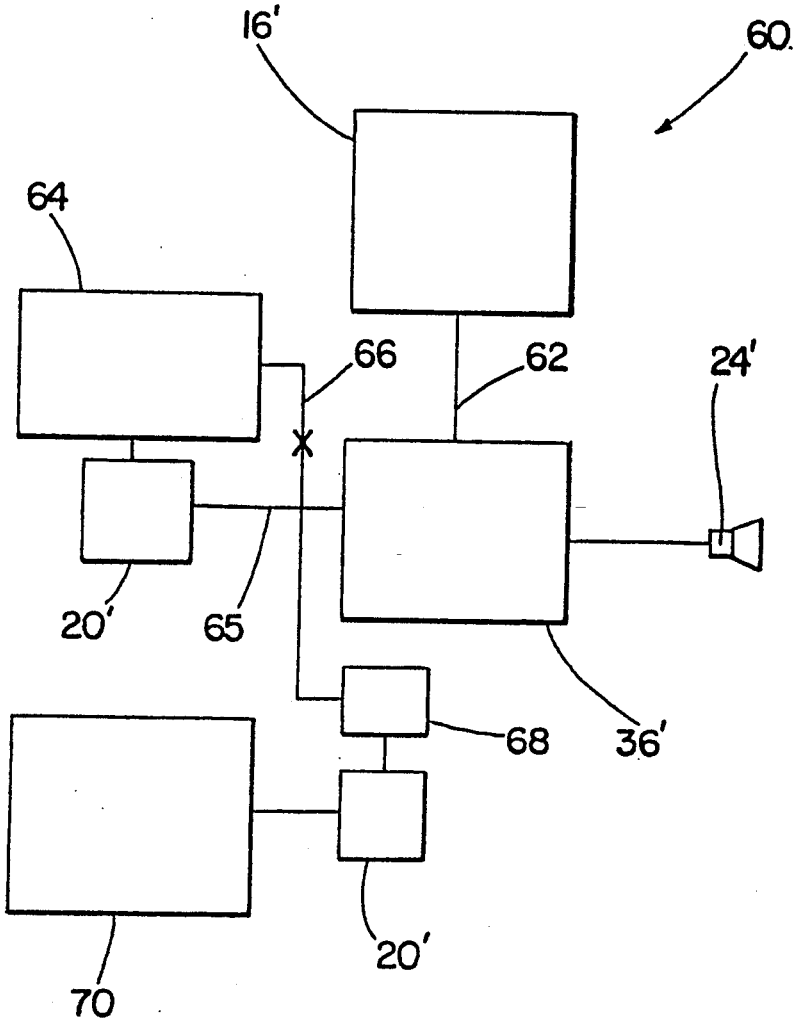
FIG. 5—A block drawing of the components at the blast site.

In an embodiment as illustrated in FIG. 5, the blasting system 60 is completely portable with each of the components movable to the blasting site. System 60 includes a pellet hopper 16' connected to a mixing chamber 36' by a pellet feed tube 62 at a desired feed rate preferably controlled by gravity and vibration. A storage container 64 contains a liquid cryogenic substance such as nitrogen and/or helium and/or oxygen. The cryogenic substance is delivered to a mixing chamber 36' and mixed with the carbon dioxide pellets for introduction into the gun 24' as discussed before. The substance in container 64 can be changed from the liquid state to the gaseous state by a vaporizer 20'. The vaporizer is connected to chamber 36' by line 65 and directs the gaseous substance thereto. The vaporizer creates a gas from the liquid supply having a pressure approximately equal to the pressure of the liquid supply. This is important because it enables the vaporizer to maintain proper pressure on the liquid storage containers for liquid withdrawal or storage.

If desired, the liquid cryogenic substance in the container 64 is directed into the mixing chamber 36' through valve controlled line 66. Also, it is within the terms of the invention to direct a gaseous and liquid mixture of the stored cryogenic substance into chamber 36'.

As discussed before, a tank of liquid oxygen 70 can be incorporated into the portable system 60 along with a vaporizer 20' and a surge vessel 68. The oxygen is mixed with the cryogenic substance in tank 64 to provide a life supporting atmosphere at the blasting site or to provide a reactive gas mixture for cleaning certain contaminants from the surface being cleaned. The surge vessel 68 controls the level of oxygen added to the other cryogenic substance, i.e. the nitrogen or helium.

The preferred embodiment stores liquid cryogenic substances in the container 64 at temperatures down to −320 degrees F. and at a pressure of 0 to 600 PSI . However, it is within the terms of the invention to store gaseous substances in containers 64 and 70.

In operation, each of the components in system 60 is moved directly to the blasting site by conventional means such as a hand truck. Then the system can be connected and operated without the need of a compressor or a gas or electric line to a remote location. The system of each embodiment controls the pressure of the propellant gas supply according to the coating or contaminant and substrate bonding relationship and the total energy requirements for the cleaning or removal of the coating or contaminant. In dry ice blasting, when the volume of the mass of the dry ice, i.e. the pellets, is constant, there is an exponential increase in the total energy of the dry ice particles as the velocity of the mass increases. The present invention keeps the volume of the pellets constant by the low temperatures available with the nitrogen and/or helium propellant and increases the velocity with high inlet pressure at the inlet of the orifice of the blasting gun.

Although several embodiments of this invention have been illustrated and described, it is to be understood by one skilled in the art that numerous changes and modifications can be carried out in this invention shown and described without departing from the spirit and scope of the claimed invention.

What is claimed is:

1. A system for blast cleaning a surface, comprising:

means for providing a high pressure stream of a cyrogenic substance having a temperature between −320 degrees F. and 150 degrees F.;

means for storing solid pellets of carbon dioxide;

means for mixing said solid pellets of carbon dioxide into said high pressure stream; and means for propelling the mixture of solid pellets and high pressure stream towards the surface to be cleaned, the high pressure stream of said cyrogenic substance being propelled in a combined liquid and gaseous state.

2. A system for blast cleaning a surface, comprising:

the steps of providing a high pressure stream of a cryogenic substance having a temperature between −320 degrees F. and 150 degrees F.;

storing said solid pellets of carbon dioxide; mixing said solid pellets of carbon dioxide into said high pressure stream; and propelling the mixture of solid pellets and high pressure stream towards the surface to be cleaned, the cyrogenic substance being selected from the group consisting essentially of nitrogen, helium, oxygen and mixtures thereof and the high pressure stream of said substance propelled in a combined liquid and gaseous state.

* * * * *